US006190817B1

(12) United States Patent
Scheonfeld

(10) Patent No.: US 6,190,817 B1
(45) Date of Patent: Feb. 20, 2001

(54) ELECTROGRAPHIC TONER, TRANSFER PROCESS AND DEVELOPMENT PROCESS FOR THE SAME

(75) Inventor: Carsten Scheonfeld, Reilingen (DE)

(73) Assignee: Heidelberger Druckmaschinen AG, Heidelberg (DE)

( * ) Notice: Under 35 U.S.C. 154(b), the term of this patent shall be extended for 0 days.

(21) Appl. No.: 08/995,079

(22) Filed: Dec. 19, 1997

(30) Foreign Application Priority Data

Dec. 23, 1996 (DE) ..... 196 54 066

(51) Int. Cl.[7] ..... G03G 9/13; G03G 9/125
(52) U.S. Cl. ..... 430/115; 430/114; 430/116
(58) Field of Search ..... 430/114, 115, 430/116

(56) References Cited

U.S. PATENT DOCUMENTS

| | | | | |
|---|---|---|---|---|
| 4,880,720 | * | 11/1989 | Drappel et al. | 430/115 |
| 4,918,487 | | 4/1990 | Coulter, Jr. . | |
| 4,974,541 | | 12/1990 | Miyabayashi . | |
| 4,996,127 | * | 2/1991 | Hasegawa et al. | 430/137 |
| 5,055,370 | * | 10/1991 | Suzuki et al. | 430/114 |
| 5,451,483 | | 9/1995 | Fuller et al. . | |
| 5,500,319 | * | 3/1996 | Funato et al. | 430/106.6 |
| 5,525,448 | | 6/1996 | Larson et al. . | |
| 5,648,193 | * | 7/1997 | Patel et al. | 430/137 |
| 5,650,256 | * | 7/1997 | Veregin et al. | 430/137 |

FOREIGN PATENT DOCUMENTS

| | | |
|---|---|---|
| 0 366 492 | 5/1990 | (EP) . |
| 55-101971 | 8/1980 | (JP) . |
| 57-30863 | 2/1982 | (JP) . |
| 5-46054 | 2/1993 | (JP) . |
| WO 96/93678 | 2/1996 | (WO) . |

OTHER PUBLICATIONS

Diamond, Arthur S. (editor) Handbook of Imaging Materials. New York: Marcel–Dekker, Inc. pp. 211–212, 1991.*
Chemical Abstracts Registry 980–26–7, 1999.*
Chemical Abstracts Registry 5281–04–9, 1999.*
Diamond, Arthur S. Handbook of Imaging Materials. New York: Marcel–Dekker, Inc. pp. 234–246, 1991.*

* cited by examiner

*Primary Examiner*—Christopher D. RoDee
(74) *Attorney, Agent, or Firm*—Kenyon & Kenyon

(57) ABSTRACT

In an electrographic toner, containing a plurality of polymer particles (4), each polymer particle has functional groups on its surface, which dissociate into two parts in a carrier liquid (6), with one part of each group remaining firmly attached to the surface, so that the individual polymer particles carry electrostatic charges in the carrier liquid. Such a toner can be used in conjunction with carrier liquids that represent no problems from the point of view of occupational safety and environmental protection. Transfer processes and a developing system for use with this toner are described.

15 Claims, 3 Drawing Sheets

4
6
7
9
8
1
U2
4
3
4
2
5
U1
U3
7
4

4
6
7
9
10
1
U2
8
3
4
10
U3
2
U1
7
10
4

ELECTROGRAPHIC TONER, TRANSFER PROCESS AND DEVELOPMENT PROCESS FOR THE SAME

FIELD OF THE INVENTION

The present invention concerns an electrographic toner, a transfer process, and a development system for developing electrostatic images.

RELATED TECHNOLOGY

Conventional development methods use either dry or liquid toners. Both cases are associated with certain inconveniences.

In the case of dry toners, it is difficult to achieve reliable triboelectric deposition of toner particles, since each individual toner particle must be brought into contact with the deposition surface in a reproducible manner. Triboelectric deposition surfaces are subject to wear due to the fact that toner material is rubbed off and minute, strongly attached dust particles are deposited. Uncharged toners result in undesirable dust buildup. Toner charged with the wrong polarity affects the sharpness of edges and the uniformity of the background. The choice of materials for toners and equipment surfaces is limited due to the triboelectric requirements for all components. In addition, toner particles with 5 $\mu$m diameter and smaller represent a health hazard by inhalation as fine dust.

Liquid developing processes are normally based on electrophoresis. The liquid toner used in this process is a non-conductive dielectric carrier liquid with suspended toner particles. The toner particles are charged via deposition of ions from the liquid, and when the liquid is brought into the proximity of the charging surface, the charged toner particles are attracted by the electric field of the latent image on the charging surface. The toner particles are transferred to the charging surface together with the carrier liquid, and the carrier liquid is then released to the atmosphere.

In order not to destroy the latent image on the charging surface, organic carrier media with a very high volume resistivity are used. A commonly used carrier medium is available from Exxon under the name Isopar. The known liquid carrier media, however, represent a problem from the point of view of occupational safety and the environment. Furthermore, the choice of materials for toner and equipment surfaces is limited due to the requirements for all components because of the electrostatic charges and compatibility with the carrier liquid. In addition, the toner is not handled economically, since the toner material is only 3% of the total developer volume.

SUMMARY OF THE INVENTION

An object of the invention is to provide a toner that can be used with liquid carrier media that are safer for the operators and the environment, as well as to provide a developing process and a developing system for this toner.

The present invention therefore provides an electrographic toner with a plurality of polymer particles wherein each polymer particle has functional groups on its surface, which functional groups can dissociate into two components in a carrier liquid, with one component of each group firmly attached to the surface, so that the individual polymer particles carry an electrostatic charge in the carrier liquid.

The toner according to the present invention can be used in combination with carrier liquids that are non-toxic, slightly volatile, incombustible, and do not attack the equipment surfaces. If the polymer particles are suspended in the carrier liquid, part of the functional groups on the surface of the polymer particles is dissociated, and each polymer particle carries an electric charge that is positive or negative depending on the type of the functional groups. Suitable carrier liquids may include aqueous solutions or other media capable of stabilizing the dissociation of the charge carriers. Surfactants or protective colloids, for example, can be used for stabilizing the suspensions in both aqueous and non-aqueous systems.

Preferably all polymer particles have basically the same number of such functional groups on their surfaces, which dissociate into two components in a carrier liquid, so that each polymer particle in the carrier liquid carries a precisely defined electric charge, determined by its chemical composition. This allows the amount of toner material to be increased in the overall volume of the developer, since, contrary to conventional liquid developing methods, there is no danger of the background purity being affected by individual particles with insufficient charge. The higher concentration of the toner in the developer saves carrier liquid and, since less carrier liquid is transferred onto the printing substrate together with the toner during printing, the remaining carrier liquid is more easily removed from the printing substrate, resulting in gentler treatment of the printing substrate.

Uniform chargeability of the polymer particles is achieved in a simple manner by having basically spherical polymer particles of basically the same size. The average diameter of the polymer particles is preferably less than 7 $\mu$m, better less than 2 $\mu$m, and the size variation is preferably approximately 10% or less. The dissociatable functional groups can either be uniformly distributed over the volume of the polymer particles or located only on the surface of the polymer particles.

Polymer particles with these properties can be prepared, for example, using heterophase polymerization, such as suspension or emulsion methods. The functional groups on the particle surface that carry the electric charges of one polarity in the carrier liquid can be, for example, phosphonate, —$SO_3$—, —$CO_2$—, or —$NR_3$+, where R is an organic radical. The carriers of the corresponding countercharges, dissociated in the carrier liquid, are preferably alkali metal or alkali earth ions, halides, small charged molecules, or polyions. Particles with such functional groups are known per se, however, they have not typically been used in toners, but only, for example, as demineralizing agents in ion exchange columns.

In a single-component developer, all polymer particles have a coloring agent. In the case of a two-component developer, a first kind of polymer particles containing a coloring agent and a second kind of polymer particles that does not necessarily contain a coloring agent are provided. If they are suspended in the carrier liquid and the countercharges are dissociated in the carrier liquid or removed therefrom, the two kinds of polymer particles have opposite polarities, with the second kind forming the carrier particles for the first kind. The number of charges per carrier particle, as well as the size and mass of the carrier particles, can be different from those of the toner particle. Often the carrier particles have a considerably larger diameter than the toner particles. The carrier particles can be electrically conducting and/or magnetized, which increases the flexibility of the system compared to a single-component system.

An electrographic developing system to be used with the above-described toner contains a movable component, which can be, for example, a continuous belt running around one or more rollers, or a rotating cylinder, and it is partially immersed in a bath with an electrode opposite the portion of the movable part that is immersed in the bath. According to the present invention, a membrane or a diaphragm is located between the surface of the component and the electrode, which membrane can be traversed by atoms or small molecules, but not by macroscopic particles such as the toner particles. The counterions dissolved in the carrier liquid are attracted toward the electrode through the membrane by a suitable voltage, and the toner particles are attracted to the developer surface of the movable component. The developer surface of the movable component has a potential selected so that the toner particles adhere to it electrostatically.

Since the counterions are permanently dissociated in the carrier liquid, the toner particles and their counterions can be physically separated using electrolysis according to the process of the present invention prior to being transferred to the developer surface. This results in an even layer of uniformly charged toner particles on the developer surface, providing outstanding print quality.

The toner particles on the developer surface are transported to a transfer point between the developer surface and an image surface, which can be, for example, a photoresistor or a dielectric image-recording medium on a rotating cylinder or a rotating belt. At the transfer point, the toner particles are transferred onto the image recording medium surface according to a latent electrostatic image on the image recording medium.

The transfer point is either a line-shaped contact surface between the developer surface and the image surface, or a narrow gap between them, which the toner particles jump over under the effect of the electrostatic fields of the latent images on the image recording medium.

An ultrasound source inducing mechanical vibrations in the developer surface can be located in the area of such a gap. By loosening the bond between the particles, the ultrasound facilitates the transfer of the toner particles onto the image areas of the latent image. The dissolution of the particle bond on the developer surface allows the gap to be made wider than it is possible with pure "jump" developing. With a wider gap, the developer liquid may contain or consist of water without danger of creating conducting connections to the latent image due to the high volume conductivity of water. In addition, the developing liquid can be concentrated on the way between the electrolytic bath and the developing gap to the point where practically only particles with a film of moisture on the surface are present. This leaves the printing paper virtually dry during printing.

The above-described developing system can operate with either a single-component developer or a two-component developer according to the present invention. When a two-component developer is used, a developing system working by the magnetic brush principle can be used as an alternative.

BRIEF DESCRIPTION OF THE DRAWINGS

Further features and advantages of the present invention are set forth in the following description of preferred embodiments with reference to the drawings, in which.

DETAILED DESCRIPTION

Figure 1:
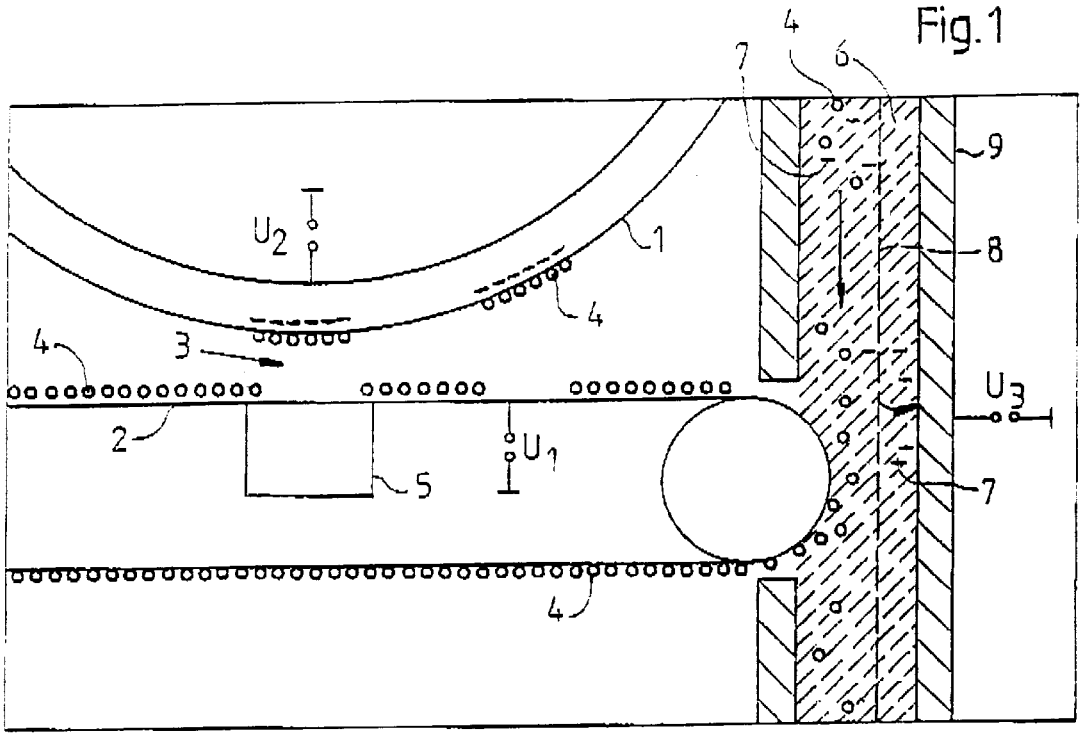
FIG. 1 shows an electrographic single-component developing system.

In FIG. 1, a latent electrostatic image in the form of a pattern of electric charges is on image surface 1, for example, a photoresistor or a dielectric image recording medium on a rotatably mounted cylinder. These charges are henceforward assumed to be negative, but they can also be positive. In the latter case, the charges and voltages mentioned in the following description should be reversed.

Positively charged toner particles 4 are brought close to this image via a developing surface 2, formed by a conveyer belt in FIG. 1, in a printing gap 3 between image surface 1 and developing surface 2.

The bond between the particles can be loosened in printing gap 3, using an appropriate auxiliary means, preferably an ultrasound device 5, which induces vibrations in the developing surfaces 2 in the area of printing gap 3. This loosening, which may be more or less intense up to the point of pulverization, facilitates the transfer of toner particles 4 onto the image areas of image surface 1. Such loosening is needed if the toner layer on developing surface 2 exceeds a certain critical volume conductivity.

Developing surface 2 carries an electric potential U1 and defines, together with potential U2 of image surface 1, the electric field for image developing. After developing, the toner layer on developing surface 2 is renewed. For this purpose, it is submerged in a bath with a liquid 6, containing fresh, positively charged toner particles 4 and dissociated counterions 7. An electrolytic cell between developing surface 2 and an electrode 9 is formed with the help of a diaphragm or a membrane 8 and an electrode 9 with potential U3. With the appropriate selection of U1 and U3, dissolved counterions 7 are attracted through membrane 8 to electrode 9, and toner particles are attracted to developing surface 2, to which they adhere electrostatically. Liquid 6 is added at the top of the figure and flows in the direction of the arrows onto the developing surface 2, along membrane 8 and electrode 9. Membrane 8 is configured so that it is penetrable by counterions 7, but not by the relatively macroscopic toner particles 4.

Toner particles 4 are given the following properties with the help of chemical preparation methods: spherical or derived shape; average diameter less than 7 $\mu$m, preferably less than 2 $\mu$m; small size variation; coloring agent in the toner particles; and a firmly defined number of functional groups on the particle surfaces, which dissociate in liquid 6 so that a portion with positive polarity remains attached to toner particles 4 and another portion with negative polarity is dissolved in liquid 6. The portion firmly attached to the toner particles can be, for example, a group of the type —$NR_3$+, where R is an organic residue, and the portion dissolved in the liquid can be, for example, a halide such as Cl— or a small charged molecule. Toner particles 4 with negative polarity would have, for example, partial groups of the type —$SO_3$— or —$CO_2$—, with alkali or alkali earth metals or small charged molecules as counterions.

A liquid 6, capable of stabilizing the charge carrier, for example, an aqueous solution or a surfactant/solvent system, is selected as liquid carrier medium for toner particles 4.

Figure 2:
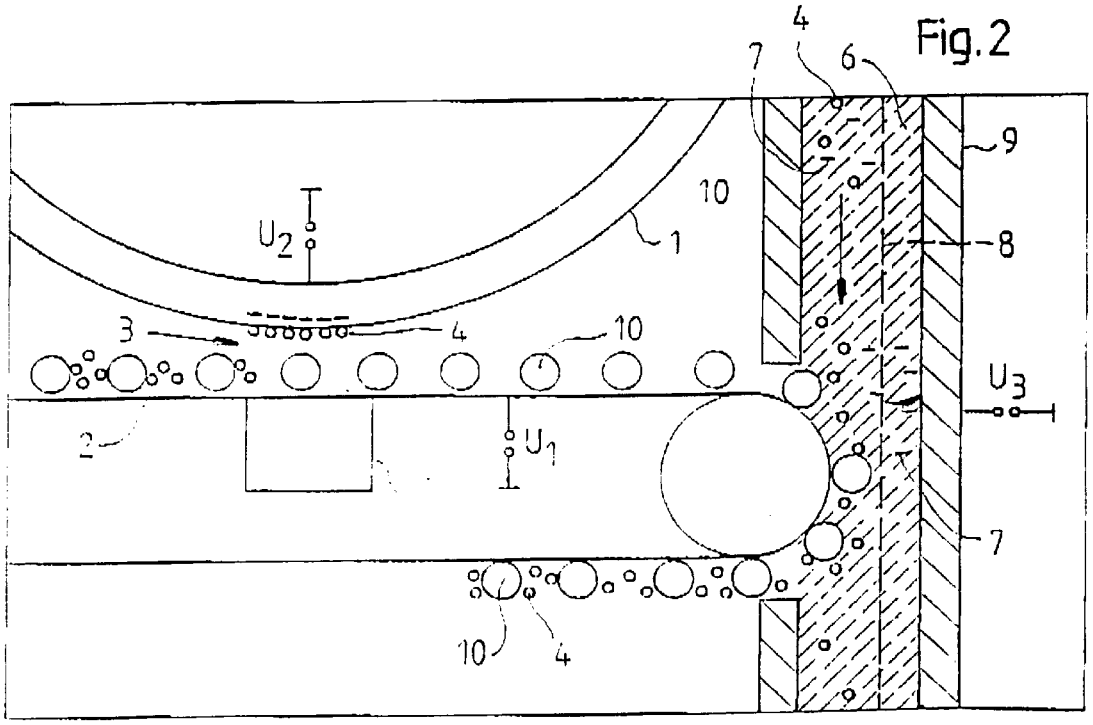
FIG. 2 shows an electrographic two-component developing system.

The two-component developing system shown in FIG. 2 does not differ in principle from that of FIG. 1, and the same components are denoted with the same reference symbols.

Unlike in FIG. 1, liquid 6 and developing surface 2 of the two-component system contain carrier particles 10 in addition to toner particles 4. Carrier particles 10, like toner particles 4, carry charged functional groups on their surfaces, which, however, have reverse polarity compared to toner particles 4.

Potentials U1 and U3 are set so that the developer is electrolyzed prior to coming close or reaching the electrical neutrality of the carrier particles/toner particles system.

Figure 3:
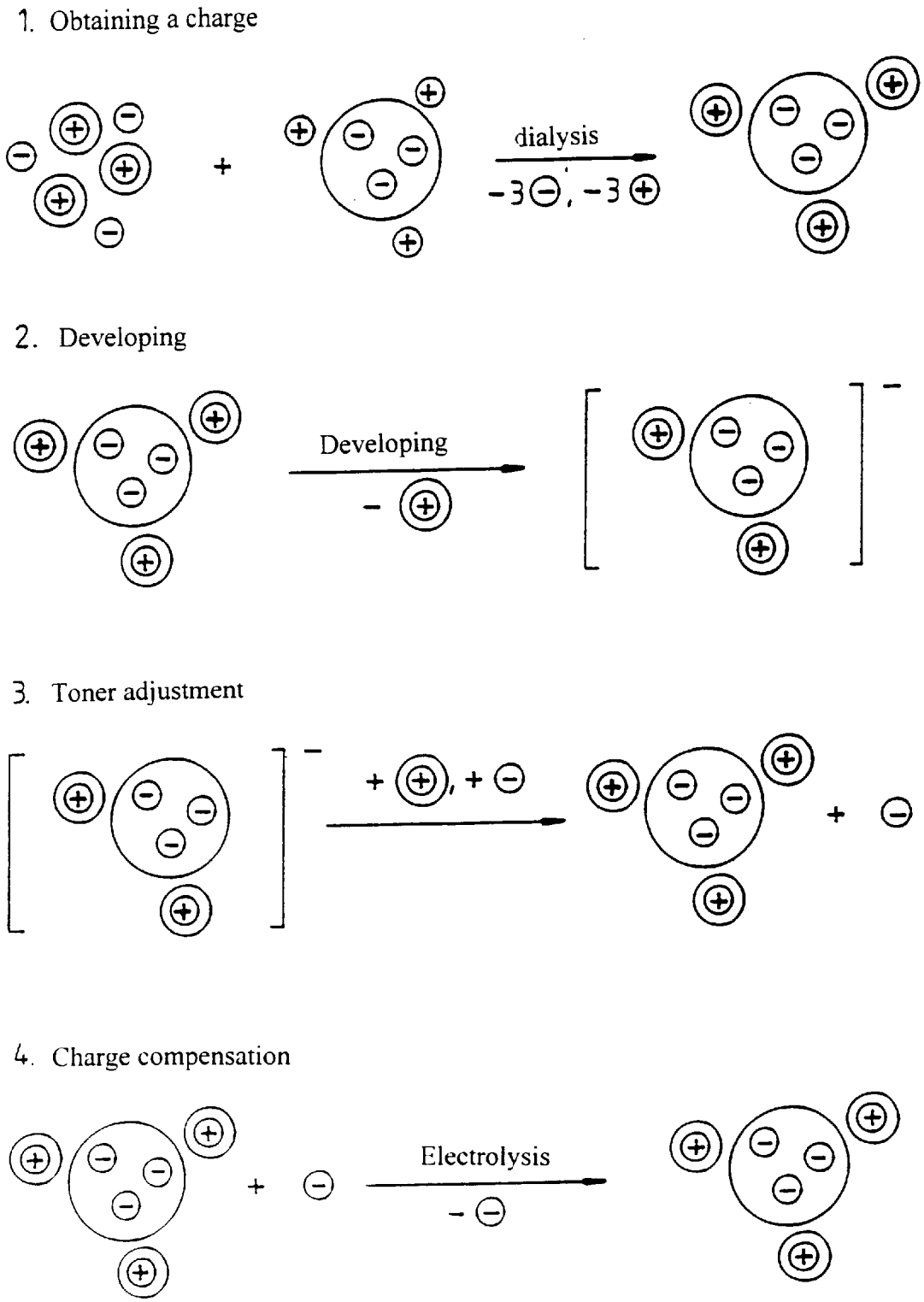
FIG. 3 is a schematic for further explanation of the electrochemical processes in the two-component developing system.

The electrochemical processes in the two-component system of FIG. 2 are somewhat more complex than those in the single-component system and are elucidated using FIG. 3, also using the example of positively charged toner particles 4 and negatively charged carrier particles 10. In this example, carrier particles 10, that are considerably larger than toner particles 4 and have three times the charge of the toner particles, are provided. These relationships can be modified if needed.

In a prior step (not illustrated), toner particles and carrier particles are prepared in separate suspensions.

In the "charge preparation" step, a mixture of toner and carrier suspensions with electric neutrality between toner particles 4 and carrier particles 10 is prepared by separating them from their counterions, e.g., by dialysis.

The developer thus prepared can be processed separately for use in the developing system.

In the "developing" step, the developer passes along the developing surface 2, leaving a negatively charged developer film with a toner deficit behind.

This toner deficit, caused by printing, is compensated again in the "toner adjustment" and "charge compensation" steps to be described below, basically in the same manner as in the single-component system with the help of the diaphragm or membrane 8 and electrode 9 to remove the counterions.

In particular, the process is conducted as follows: after a basically stationary film of negatively charged carrier particles 10 has been applied to developing surface 2, to which some toner particles 4 also adhere, or additional toner particles 4 are added to liquid 6 simultaneously with carrier particles 10. These additional toner particles 4 dissociate in liquid 6 into positively charged toner particles 4 and their negatively charged counterions 7, or they are already dissociated if toner particles 4 are added in the form of a prepared suspension. The number of additional toner particles 4 must be much greater than that of the added carrier particles 10 during printing since toner particles 4 are consumed during printing, while the loss of carrier particles 10 is much lower. In the "toner adjustment" step, such individual toner particles 4 are deposited at the unoccupied points of carrier particles 10 on the developing surface, and in the "charge compensation" step the corresponding counterions 7 are attracted onto electrode 9 through membrane 8.

While carrier particles 10, saturated with toner particles 4, are electrically neutral overall, they still adhere to developing surface 2 due to the uneven charge distribution, and are transported into printing gap 3, as shown in FIG. 2. In printing gap 3, carrier particles 10 selectively release some or all toner particles 4 onto image surface 1, from where they are subsequently transferred onto a printing substrate or an intermediate carrier.

In the embodiments illustrated in FIGS. 1 and 2, a conveyer belt can also be used instead of the cylindrical image surface 1, and inversely, a developing surface formed by a rotatable cylinder can be used instead of developing surface 2, formed by a conveyer belt in FIGS. 1 and 2.

With a two-component developer, a developing system operating with magnetic brushes can also be used. Such an embodiment, not separately illustrated in the drawing, could be designed, so that, contrary to the arrangement illustrated in FIG. 2, developing surface 2 and image surface 1 do not touch, but are separated by a narrow printing gap 3, and a magnetic brush is arranged between developing surface 2 and image surface 1 with the help of appropriate magnetic fields for transferring toner particles 4 and carrier particles 10 from developing surface 2 to image surface 1.

This arrangement eliminates two problems associated with previous magnetic brush developers. First, the carrier particles are not responsible for depositing the toner particles, which is done triboelectrically in conventional two-component developers, and thus they are not subject to wear. Second, the mixing ratio between toner particles and carrier particles does not have to be adjusted, but it is obtained from the electric neutrality of the developer in the above-described "charge compensation" step.

If electrically conducting carrier particles are used, potential U1 of the developing surface is immediately brought up to that of the latent image and also counteracts the depletion potential locally by removing the toner particles from the developer. This depletion potential appears in systems with non-conducting carrier particles due to the fact that the strength of bonding of the remaining toner particles increases after a toner particle is removed from a carrier particle.

Figure 4:
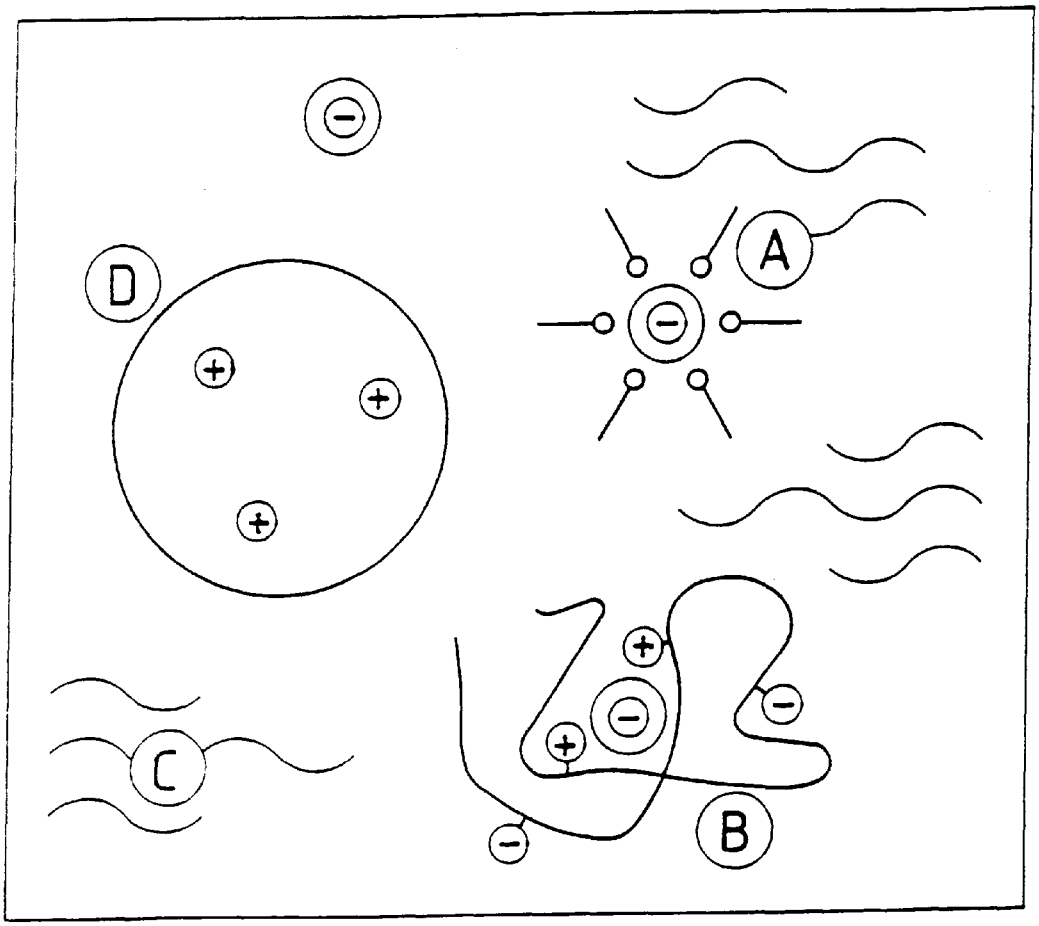
FIG. 4 is a schematic showing the developer suspension used in the two-component developer system.

FIG. 4 schematically shows the developer suspension of the two-component system. It comprises toner particles, which can be stabilized chemically in the suspension (A and B), developer liquid (C) and carrier particles (D), which can also be stabilized chemically, which, however, is not shown in the figure.

The developer liquid is preferably an aqueous solution, which is concentrated on its way between the electrolytic bath and the developing gap so that virtually only particles with a film of surface moisture remain. The high volume conductivity of water makes, however, the use of an breakup unit such as ultrasound source 5 necessary, so that no conductive bonds are created from the latent image to potential-conducting parts. It is therefore assumed that water is less well suited for the use of the magnetic brush principle, or that it must be completely eliminated before it reaches the printing gap.

What is claimed is:

1. An electrographic toner comprising:

a plurality of polymer particles suspended in a carrier liquid including water, each polymer particle having a surface and each polymer particle having functional groups on the surface, the functional groups capable of dissociating into a first and second part in the carrier liquid, the first part of the functional groups remaining firmly attached to the surface so that the polymer particles in the carrier liquid carry an electrostatic charge, the second part being dissociated in the carrier liquid, wherein the plurality of polymer particles include a first type of polymer particles and a second type of polymer particles and the second part of the functional groups of the first type of polymer particles has a different polarity from the second part of the functional groups of the second type of polymer particles.

2. The electrographic toner as recited in claim 1 wherein all of the plurality of polymer particles have the same number of functional groups on the surface.

3. The electrographic toner as recited in claim 2 wherein the size variation of the polymer particles is 10% or less.

4. The electrographic toner as recited in claim 1 wherein the plurality of the polymer particles have a spherical shape and are the same size as each other.

5. The electrographic toner as recited in claim 1 wherein the first part of the functional groups is $SO_3$, $CO_2$, phosphonate, or $NR_3$, where R is an organic radical.

6. The electrographic toner as recited in claim 1 wherein the second part of the functional groups can dissociate in the carrier liquid and the second part comprises alkali or alkali earth metal ions, halides, or polyions.

7. The electrographic toner as recited in claim 1 wherein the polymer particles include a coloring agent.

8. The electrographic toner as recited in claim 7 wherein the average diameter of the polymer particles is less than 7 $\mu$m.

9. The electrographic toner as recited in claim 7 wherein the average diameter of the polymer particles is less than 2 $\mu$m.

10. The electrographic toner as recited in claim 1 wherein the carrier liquid includes a surfactant and/or protective colloid.

11. The electrographic toner as recited in claim 1 wherein the polymer particles of the second type are electrically conductive.

12. The electrographic toner as recited in claim 1 wherein the polymer particles of the second type contain a soft magnetic material.

13. The electrographic toner as recited in claim 1 wherein the polymer particles of the second type have a larger diameter than those of the first type of polymer particles.

14. An electrographic toner comprising:

a plurality of polymer particles suspended in a carrier liquid, each polymer particle having a surface and each polymer particle having functional groups on the surface, the functional groups capable of dissociating into a first and second part in the carrier liquid, the first part of the functional groups remaining firmly attached to the surface so that the polymer particles in the carrier liquid carry an electrostatic charge, the second part being dissociated in the carrier liquid, wherein the plurality of polymer particles include a first type of polymer particles and a second type of polymer particles and the second part of the functional groups of the first type of polymer particles has a different polarity from the second part of the functional groups of the second type of polymer particles, the polymer particles of the first type having a coloring agent and the polymer particles of the second type having no coloring agent.

15. The electrographic toner as recited in claim 14 wherein the polymer particles of the second type have a larger diameter than those of the first type of polymer particles.

* * * * *

UNITED STATES PATENT AND TRADEMARK OFFICE

CERTIFICATE OF CORRECTION

PATENT NO. : 6,190,817 B1
DATED : February 20, 2001
INVENTOR(S) : Carsten Schönfeld It is certified that error appears in the above-identified patent and that said Letters Patent is hereby corrected as shown below:

Title page,
Item [12], please change the last name of the inventor to -- Schönfeld --; and
Item [75], please change the last name of the inventor to -- Schönfeld --.

Signed and Sealed this

Eighteenth Day of December, 2001

*Attest:*

*Attesting Officer*

JAMES E. ROGAN
*Director of the United States Patent and Trademark Office*